US005159969A

United States Patent [19]

Larreco et al.

[11] Patent Number: 5,159,969

[45] Date of Patent: Nov. 3, 1992

[54] DEVICE FOR THE CONTINUOUS CASTING OF THIN METAL STRIPS BETWEEN TWO ROLLS

[75] Inventors: Michel M. Larreco, Metz; Jacques M. Spiquel, Montigny-Les-Metz; Herve Tavernier, Vandoeuvre, all of France

[73] Assignee: Usinor Sacilor, Puteaux, France

[21] Appl. No.: 615,787

[22] Filed: Nov. 20, 1990

[30] Foreign Application Priority Data

Nov. 22, 1989 [FR] France ..... 89 15340

[51] Int. Cl.[5] ..... B22D 11/06; B22D 11/10

[52] U.S. Cl. ..... 164/415; 164/428

[58] Field of Search ..... 164/428, 480, 415, 475

[56] References Cited

U.S. PATENT DOCUMENTS

| | | | |
|---|---|---|---|
| 3,672,433 | 6/1972 | Daussan | 164/123 |
| 3,876,420 | 4/1975 | Phoenix et al. | 164/123 X |
| 4,987,949 | 1/1991 | Sakaguchi et al. | 164/428 X |

FOREIGN PATENT DOCUMENTS

| | | | |
|---|---|---|---|
| 2619032 | 2/1989 | France | 164/428 |
| 58-224048 | 12/1983 | Japan | 164/480 |
| 61-7049 | 1/1986 | Japan . | |
| 62-130749 | 6/1987 | Japan . | |
| 63-154245 | 6/1988 | Japan | 164/428 |
| 1-271037 | 10/1989 | Japan | 164/480 |

OTHER PUBLICATIONS

Abstract of Japanese Patent Publication 62-40955, published Feb. 21, 1987.

Abstract of Japanese Patent Publication 63-177945, published Jul. 22, 1988.

Abstract of Japanese Patent Publication 60-21161, published Feb. 2, 1985.

Abstract of Japanese Patent Publication 62-130749, published Jun. 13, 1987.

Abstract of Japanese Patent Publication 61-7049, published Jan. 13, 1986.

*Primary Examiner*—J. Reed Batten, Jr.

*Attorney, Agent, or Firm*—Cushman, Darby & Cushman

[57] ABSTRACT

A device for the continuous casting of thin metal strips includes two parallel spaced rotatable rolls, side walls located at the ends of the rolls and defining with the rolls a casting space for liquid metal, a flat cover disposed above the liquid metal and in the immediate vicinity of the meniscus of the liquid metal so as to form a thermal screen which is so dimensioned as to cover the whole of the surface of the liquid metal. The cover is provided with a refractory lining on the side of the cover facing toward the liquid metal and bearing against the two rolls. This cover forms a thermal screen or shield preventing any surface solidification of the bath of liquid metal from starting. Advantageously, an inert gas may be injected between the meniscus and the cover through the latter.

3 Claims, 1 Drawing Sheet

FIG. 1
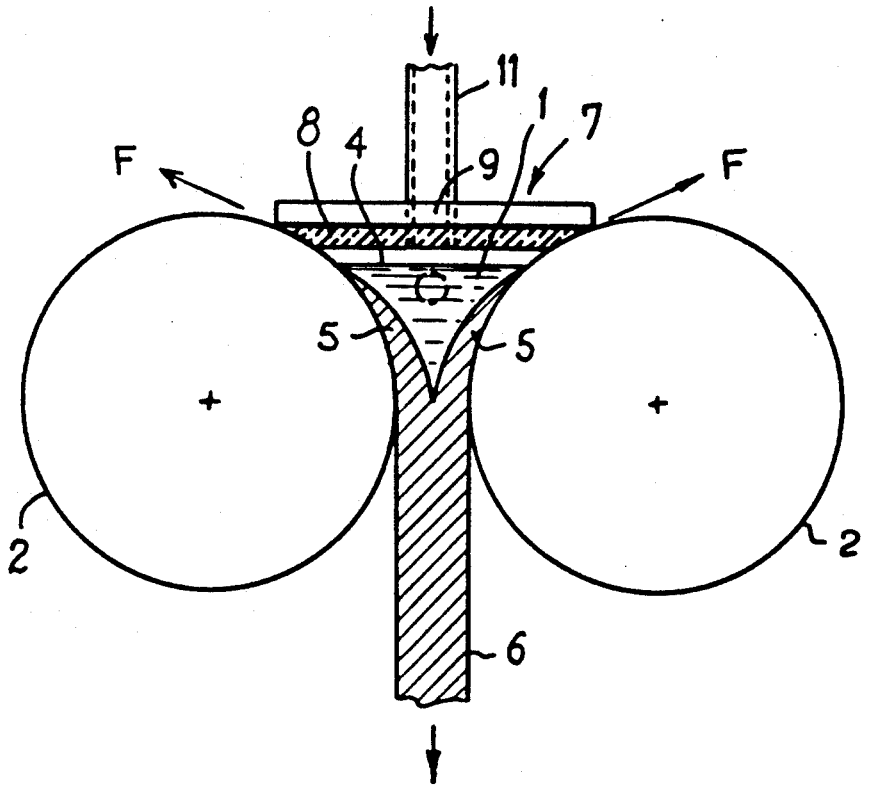
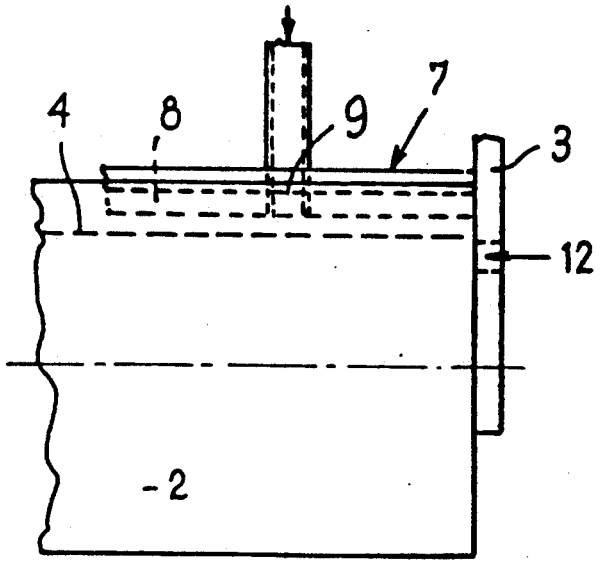
FIG. 2

DEVICE FOR THE CONTINUOUS CASTING OF THIN METAL STRIPS BETWEEN TWO ROLLS

The present invention relates to a device for the continuous casting of thin metal strips between two parallel rotating rolls, this device further comprising side walls for retaining the liquid metal at the ends of the rolls and defining with the latter a casting space for the liquid metal.

It is known that the contact of the surface of the liquid metal with air in the casting space between the rolls in such a device has adverse effects on the composition of the thin strips obtained owing to, in particular, inclusions of oxides which may result from this contact.

It has therefore been proposed to protect the surface of the liquid metal against oxidation by means of a parallel-sided box which is disposed in bearing relation to the rolls and through which liquid metal is poured vertically from a vessel located above the box, a neutral gas being injected into the interior of the box through its lateral wall (Document JP-A-62 130 749).

However, such a device does not perform the function of a thermal screen capable of sufficiently reflecting heat onto the surface of the liquid metal, termed "meniscus", to prevent any surface solidification of the metal from starting. Indeed, owing to the parallel-sided shape of the box, the upper side of the box is relatively remote from the meniscus.

A device is also known (Document JP-A-61 007 049) in which such a box covers the surface of the liquid metal and is provided in its upper side with an opening for pouring the liquid metal coming from a vessel placed above the box. In this case, the box provides no protection of the meniscus of the liquid metal against atmospheric oxidation and moreover only poorly performs the function of a thermal screen that it is supposed to perform, owing to its very dimensions.

An object of the invention is therefore to overcome these drawbacks.

According to the invention, the device for the continuous casting of thin metal strips between two parallel rotatable rolls comprises a flat cover disposed above the casting space of the liquid metal and in the immediate vicinity of the location of the meniscus so as to form a thermal screen so dimensioned as to cover the whole of the surface of the liquid metal, said cover being provided with a refractory lining on the side thereof facing toward the liquid metal and bearing against the two rolls.

The fact that the cover bears by its longitudinal edge portions against the rolls presents no drawback and the very small distance between the meniscus and the surface of the refractory lining enables the cover to fully perform its function of a thermal screen by returning to the liquid metal substantially all of the heat given off by the latter. Under these conditions, any surface solidification of the liquid metal is substantially prevented from starting.

According to a feature of the invention, the side walls applied against the ends of the rolls are provided with orifices for supplying liquid metal to the casting space defined between the two rolls.

This manner of supplying liquid metal is indeed much more advantageous than that consisting in feeding the casting space from above through a box, as in prior arrangements. Indeed, the vertical component of the liquid metal poured into the casting space by a ladle located directly above this space results in turbulences and a partial mixture of the fresh liquid metal with the metal in process of solidification within the casting space, which is undesirable as concerns the quality of the product obtained. In contrast, supplying the liquid metal through the side walls creates only a minimum amount of turbulence in the bath of liquid metal, which is a factor improving the homogeneity and therefore the quality of the thin strips obtained.

Further features and advantages of the invention will be apparent from the following description with reference to the accompanying drawing which illustrates an embodiment of the invention by way of a non-limitative example.

FIG. 1 is an end elevational view of an embodiment of the continuous casting device according to the invention;

FIG. 2 is a partial longitudinal elevational view of the device shown in FIG. 1.

The device shown in the drawing is adapted to effect a continuous casting of a liquid metal 1 such as steel between two parallel rotatable rolls 2 which may be driven in rotation in the known manner by driving means (not shown).

The two rolls 2 define therebetween a casting space filled with the bath of liquid metal 1, this space being closed at the ends of the rolls by two plates 3, termed side dams. The bath of liquid metal 1 has a surface 4 termed a meniscus from the edges of which the liquid metal solidifies or freezes in downwardly travelling along the surface of the rolls 2 and forms tongue portions 5 of increasing thickness which join up and constitute a thin metal strip 6 which is extracted from the device by the effect of gravity.

The device is provided with a flat cover 7 disposed above the liquid metal casting space and in the immediate vicinity of the meniscus 4 of this metal. The cover is formed by a plate which is so dimensioned as to cover the whole of the surface of the liquid metal and bear, beyond the edges of the meniscus 4, against the surface of the rolls 2. Provided on the lower side of the cover 7 facing toward the liquid metal 1 is a lining 8 which is refractory with respect to the liquid metal and has a suitable thickness and a surface in the immediate vicinity of the meniscus 4.

The cover 7 is provided with an opening 9 with which communicates a pipe 11 for injecting a neutral gas through the cover 7 into the volume defined by the meniscus 4 and the surface of the refractory lining 8.

The casting space between the rolls 2 is fed with liquid metal through orifices 12 provided in the side walls or dams 3 by any known means (not shown).

The operation and the advantages of the device just described are as follows.

The casting space is supplied with liquid metal through the orifices 12 in the side walls 3. In addition, a neutral gas is injected at a boosted pressure into the volume defined by the meniscus 4 and the refractory lining 8 through the pipe 11 and the opening 9. The atmosphere is consequently expelled from the periphery of the cover 7 and the neutral gas escapes along the sides of the cover 7, as shown by the arrows F. In this way, instead of bearing directly on the surface of the rolls 2, the cover 7 can then rest on a cushion of this gas if the boosted pressure of the neutral gas is sufficient.

Owing to its flatness, the cover 7 is placed by its refractory lining in the immediate vicinity of the meniscus 4 and therefore effectively performs its function of a thermal screen for the bath of liquid metal 1.

Further, the injection of a neutral gas between the meniscus 4 and the refractory lining 8 protects the surface of the liquid metal against any risk of oxidation.

The refractory lining 8 may be formed by a combination of fibrous refractory layers affording a good thermal insulation of the ingot mould and avoiding in a satisfactory manner an untimely heating of the cover 7. However, such a lining if left bare would result, as it rises in temperature, in a gaseous emanation which is mainly carbonaceous and may be harmful to the personnel and a hindrance to the correct operation of the installation. In particular, it may disturb the operation of the apparatuses for optically measuring the level of the metal. Moreover, these linings are rapidly degraded by liquid metal splashes which are always to be feared if the cover 7 is placed at a very short distance from the meniscus, as is in fact desirable. This is why it is preferred to cover this combination of fibrous refractory layers on the side facing toward the liquid metal with a cloth of polycrystalline continuous ceramic fibers, and even to cover both sides of the fibrous refractory lining with a layer of such ceramic fibers. These fibers, composed of metal oxides, such as $SiO_2$, $Al_2O$, $B_2O_3$, support point contacts with the liquid metal and a slight heating with a blowpipe before their use eliminates any volatile material therefrom which could adversely affect the casting operation. Further, these cloths of white color are highly emissive and effectively return the radiation to the meniscus. Lastly, they perform a thermal flux screen and retard or suppress the gaseous emanations from the fibrous refractory layers. It will be understood that it is also possible to achieve the insulation of the cover solely by means of such a cloth of ceramic fibers.

The scope of the invention is not intended to be limited to the described embodiment and may encompass variants. Thus, it is not essential to inject a neutral gas between the meniscus 4 and the cover 7. In this case, the latter bears directly against the surface of the rolls 2. It may then be advantageous, so as to limit wear, to make the part of the refractory lining 8 which must come into contact with the rolls from a dense refractory. The rest of the lining 8 may be composed of a softer material such as the aforementioned fibrous refractory.

What is claimed is:

1. A device for the continuous casting of thin metal strips between two rotatable spaced parallel rolls comprising:

side walls for retaining liquid metal at ends of said rolls and defining with said rolls a casting space for the liquid metal which liquid metal has a surface defining a meniscus;

a flat cover disposed above said casting space and above but in the immediate vicinity of the location of the meniscus so as to constitute a thermal screen which is so dimensioned as to cover the whole of the surface of the liquid metal;

a refractory lining provided on the side of said cover which faces toward the liquid metal, said cover being in supported relation to said two rolls; and means in said cover for injecting a neutral gas at a boosted pressure in the space between the meniscus and said refractory lining, the boosted pressure being such as to constitute a cushion interposed between said rolls and said cover for supporting said cover.

2. A device for the continuous casting of thin metal strips between two rotatable spaced parallel rolls comprising:

side walls for retaining liquid metal at ends of said rolls and defining with said rolls a casting space for the liquid metal which liquid metal has a surface defining a meniscus;

orifices in said side walls for supplying liquid metal to said casting space;

a flat cover disposed above said casting space and above but in the immediate vicinity of the location of the meniscus so as to constitute a thermal screen which is so dimensioned as to cover the whole of the surface of the liquid metal; and a refractory lining provided on the side of said cover which faces toward the liquid metal, said cover being in supported relation to said two rolls; and means in said cover for injecting a neutral gas at a boosted pressure in the space between the meniscus and said refractory lining.

3. A device for the continuous casting of thin metal strips between two rotatable spaced parallel rolls comprising:

side walls for retaining the liquid metal at ends of said rolls and defining with said rolls a casting space for the liquid metal which liquid metal has a surface defining a meniscus;

a flat cover disposed above said casting space and above but in the immediate vicinity of the location of the meniscus so to constitute a thermal screen which is so dimensioned as to cover the whole of the surface of the liquid metal;

a refractory lining provided on the side of said cover which faces toward the liquid metal and comprising a combination of fibrous refractory layers and a cloth of polycrystalline continuous ceramic fibers, said cover being in supported relation to said two rolls; and mean in said cover for injecting a neutral gas at a boosted pressure in the space between the meniscus and said refractory lining.

* * * * *